US005277164A

United States Patent [19]

Takahashi et al.

[11] Patent Number: 5,277,164

[45] Date of Patent: Jan. 11, 1994

[54] METHOD AND APPARATUS FOR CONTROL OF ENGINE FUEL INJECTION

[75] Inventors: Shinsuke Takahashi, Yokohama; Teruji Sekozawa, Kawasaki; Makoto Shioya, Suginami; Seiji Asano, Katsuta, all of Japan

[73] Assignee: Hitachi, Ltd., Tokyo, Japan

[21] Appl. No.: 706,588

[22] Filed: May 28, 1991

[30] Foreign Application Priority Data

May 29, 1990 [JP] Japan ..... 2-137157

[51] Int. Cl.[5] ..... F02D 41/10

[52] U.S. Cl. ..... 123/492

[58] Field of Search ..... 123/478, 480, 492

[56] References Cited

U.S. PATENT DOCUMENTS

| | | | |
|---|---|---|---|
| 4,889,100 | 12/1989 | Nakaniwa et al. | 123/492 |
| 4,897,791 | 1/1990 | Sekozawa et al. | 123/492 X |
| 4,974,563 | 12/1990 | Ikeda et al. | 123/492 X |
| 4,987,888 | 1/1991 | Funabashi et al. | 123/492 X |
| 4,987,889 | 1/1991 | Fujita et al. | 123/492 |
| 5,003,950 | 4/1991 | Kato et al. | 123/492 X |
| 5,003,953 | 4/1991 | Weglarz et al. | 123/492 X |
| 5,050,084 | 9/1991 | Nakaniwa | 123/492 X |
| 5,068,794 | 11/1991 | Hosaka | 123/492 X |

FOREIGN PATENT DOCUMENTS 0391385 10/1990 European Pat. Off. .

OTHER PUBLICATIONS

*Patent Abstracts of Japan*, vol. 8, No. 201 (M-325), Sep. 14, 1984 (for Japanese Kokai 59-90768 published May 25, 1984).

*Patent Abstracts of Japan*, vol. 13, No. 45 (M-792), Feb. 2, 1989 (for Japanese Kokai 63-253137 published Oct. 20, 1988).

*Patent Abstracts of Japan*, vol. 14, No. 113 (M-944), Mar. 2, 1990 (for Japanese Kokai 1-313639 published Dec. 19, 1989).

*Patent Abstracts of Japan*, vol. 14, No. 323 (M-997), Jul. 11, 1990 (for Japanese Kokai 2-108834 published Apr. 20, 1990).

*Patent Abstracts of Japan*, vol. 14, No. 404 (M-1018), Aug. 31, 1990 (for Japanese Kokai 2-153244 published Jun. 12, 1990).

*Primary Examiner*—Tony M. Argenbright

*Attorney, Agent, or Firm*—Antonelli, Terry, Stout & Kraus

[57] ABSTRACT

A method and an apparatus for control of engine fuel injection are characterized by detecting the state of the acceleration of the engine and also judging whether or not the engine is in a specific acceleration state, by, when the engine is judged to be in a specific state of acceleration, using such a value as a crank shaft angle obtained in advance in order to predict the air mass flow rate of the air flowing into a specific cylinder having undergone a fuel injection, by using the predicted air mass flow rate or the crank shaft angle to determine a proper asynchronous fuel injection quantity for the above-mentioned acceleration state for the specific cylinder, and then by performing an asynchronous injection. In this way, it is possible to calculate the shortage of fuel occurring with the synchronous injection even at the early stage of acceleration by using various variables so as to determine a proper supplemental fuel supply quantity (asynchronous injection quantity) for achieving a desired air fuel ratio in various drive modes.

17 Claims, 5 Drawing Sheets

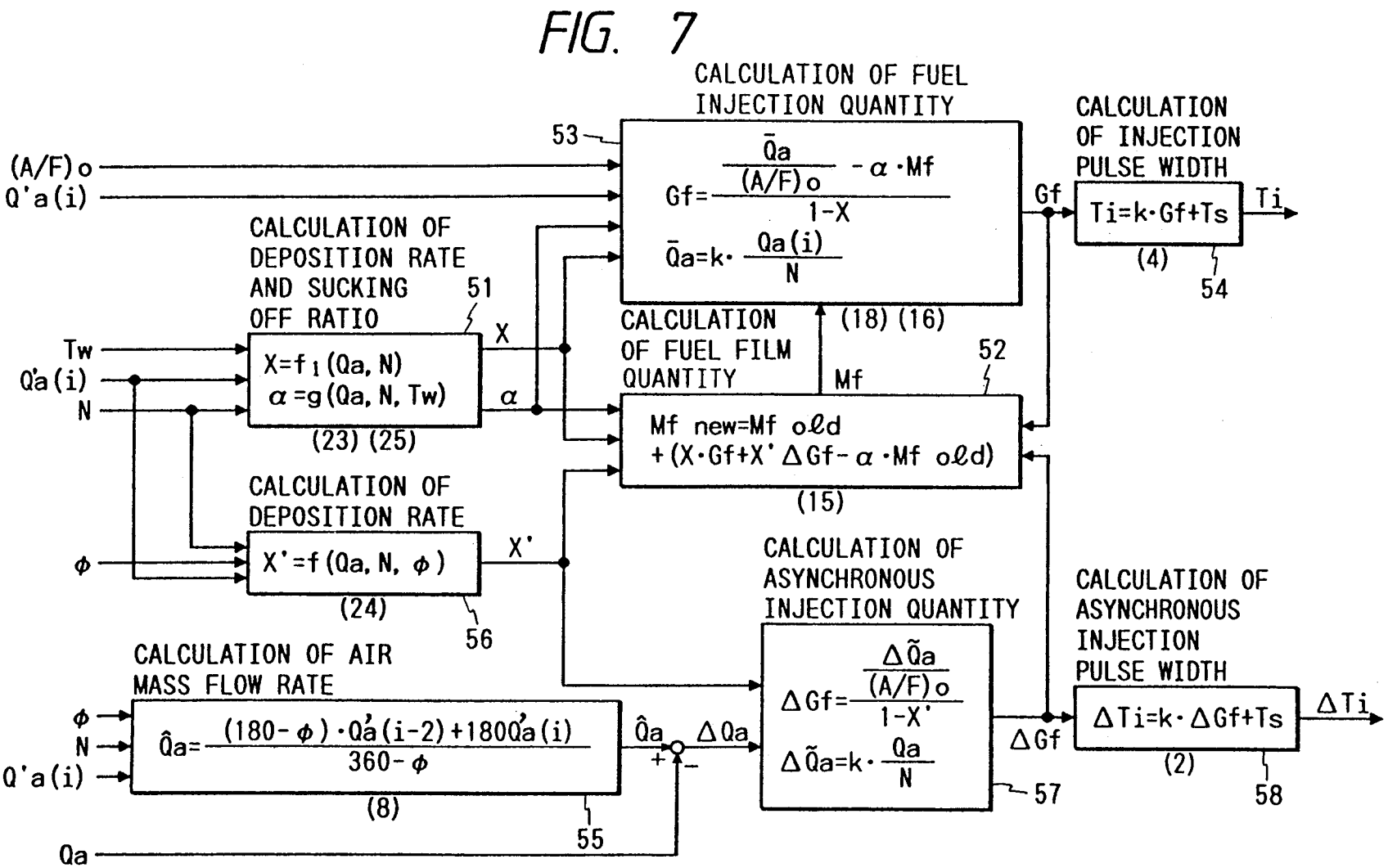
FIG. 7
CALCULATION OF FUEL INJECTION QUANTITY
53
CALCULATION OF INJECTION PULSE WIDTH
Ti=k·Gf+Ts
(4)
54
Ti
Gf
CALCULATION OF FUEL FILM QUANTITY
(18) (16)
Mf
52
Mf new=Mf oℓd + (X·Gf+X'ΔGf−α·Mf oℓd)
(15)
CALCULATION OF ASYNCHRONOUS INJECTION QUANTITY
57
ΔGf
CALCULATION OF ASYNCHRONOUS INJECTION PULSE WIDTH
ΔTi=k·ΔGf+Ts
(2)
58
ΔTi
ΔQa
CALCULATION OF DEPOSITION RATE AND SUCKING OFF RATIO
51
X
α
X=f1(Qa, N)
α=g(Qa, N, Tw)
(23) (25)
CALCULATION OF DEPOSITION RATE
56
X'
X'=f(Qa, N, φ)
(24)
CALCULATION OF AIR MASS FLOW RATE
55
(8)
(A/F)o
Q'a(i)
Tw
Q'a(i)
N
φ
φ
N
Q'a(i)
Qa

METHOD AND APPARATUS FOR CONTROL OF ENGINE FUEL INJECTION

BACKGROUND OF THE INVENTION

The present invention relates to a method of controlling engine fuel injection, and is particularly concerned with a method and apparatus for asynchronous injection in an electronic controller of an automobile engine.

An electronic controller of an automobile engine controls the quantity of a gasoline injection in accordance with the air mass which flows into the engine in response to the angle of the accelerator pedal so as to obtain a theoretical air fuel ratio. In other words, it obtains the air mass flow rate of the air flowing into the cylinder, uses an electric circuit such as a microprocessor to obtain a required fuel quantity and then controls the quantity of fuel injection. In the fuel injection control by conventional electronic engine controllers, especially for fuel injection control during acceleration of the automobile, to make up for the shortage of fuel occurring with a synchronous injection during acceleration, an asynchronous injection is performed by using a compensation coefficient obtained by table lookup whose parameter is the throttle opening angle variation, as described on pages 116 to 117 of "Electronic Controlled Gasoline Injection," Sankaido, May 5, 1987.

According to the technique shown in the above-mentioned text, for every engine model a table must be produced by trial-and-error, search of table data with throttle opening angle variations used as one of the parameters. Therefore, such a technique has the disadvantage that a large number of processes are needed for producing the table.

In the first place, the shortage of fuel to be made up for by an asynchronous injection should be specified as a value equivalent to the difference between the air mass flow rate of the air actually drawn into the engine and the air mass flow rate of the air used for calculating the synchronous injection. For this purpose, it is necessary to directly or indirectly use the time of acceleration and the responding air mass flow rate at the inlet port during the early stage of acceleration. However, conventionally no attention has been paid to the time of acceleration in relation to an induction stroke, and the quantity of asynchronous injection has been calculated in most cases by using only an opening angle variation, with the result that excessive or insufficient asynchronous injections still occur with shifts in the time of acceleration. Therefore, prior art attempts have the disadvantage that it is impossible to determine a proper asynchronous injection quantity for achieving a desired air fuel ratio in various drive modes.

SUMMARY OF THE INVENTION

A primary object of the present invention is, therefore, to provide an engine fuel injection control method and apparatus for determining a proper air fuel ratio in every drive mode without using a table whose data would have to be obtained by trial and error, so as to eliminate the above-mentioned disadvantages.

To achieve this object, a method and apparatus according to the present invention are characterized in that in controlling the quantity of fuel supply to a cylinder of the engine according to the air mass flowing into the cylinder, the state of acceleration of the engine is detected and also it is judged whether or not the engine is in a specific acceleration state, that, when the engine is judged to be in a specific state of acceleration, the air mass flow rate of the air flowing into a specific cylinder having undergone a fuel injection is predicted, that the predicted air mass flow rate is used for determining a proper asynchronous fuel injection quantity for the above-mentioned acceleration state for the above-mentioned specific cylinder, and then that the determined quantity of fuel is injected asynchronously into the above-mentioned specific cylinder.

Note that the above-mentioned proper asynchronous fuel injection quantity may be determined according to a crank angle detected in advance.

In a preferred embodiment of the above-mentioned method and apparatus, the asynchronous fuel injection quantity is determined so that it can be a supplemental fuel supply quantity necessary for achieving a proper air fuel ratio for the above-mentioned predicted air mass flow rate. Note that the above-mentioned specific cylinder is a cylinder having the latest fuel injection. It is desirable that an asynchronous injection quantity should be determined by fuel supply quantity calculation with regard to the difference between the predicted air mass flow rate of the air flowing into the cylinder having the latest fuel injection and the air mass flow rate used for calculating the fuel supply quantity so that a desired air fuel ratio can be achieved.

Concerning the characteristic effects of the present invention, it is possible to judge acceleration to calculate the shortage of fuel occurring in a cylinder with synchronous injection at the early stage of acceleration by using a predicted air mass flow rate, the time of acceleration and various other variables. Therefore, a proper supplemental fuel supply quantity (asynchronous injection quantity) for achieving a desired air fuel ratio in various drive modes can be determined. Besides, a proper asynchronous fuel injection quantity can be determined without using a table requiring matching, so that the processes of developing a fuel injection system can be decreased in number.

The foregoing and other objects, advantages, manner of operation and novel features of the present invention will be understood from the following detailed description when read in connection with the accompanying drawings.

BRIEF DESCRIPTION OF THE DRAWINGS

In the accompanying drawings: FIG. 7 is a flow diagram of the calculation processes in an engine fuel injection control method which embodies the present invention.

DETAILED DESCRIPTION OF THE PREFERRED EMBODIMENT

Figure 1A:
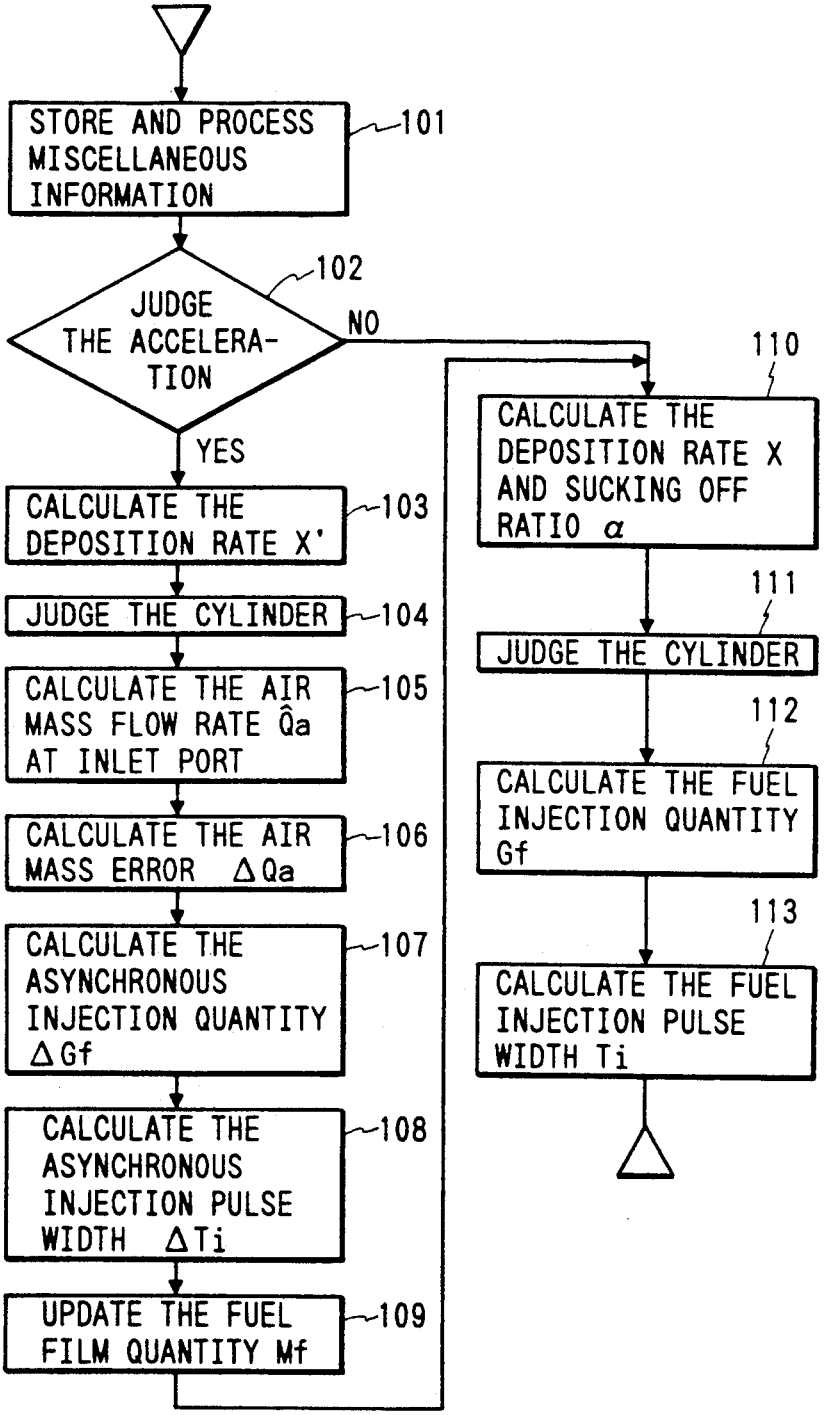
FIG. 1*a*–1*b* are flowcharts of an engine fuel injection control method which embodies the present invention.
Figure 1B:
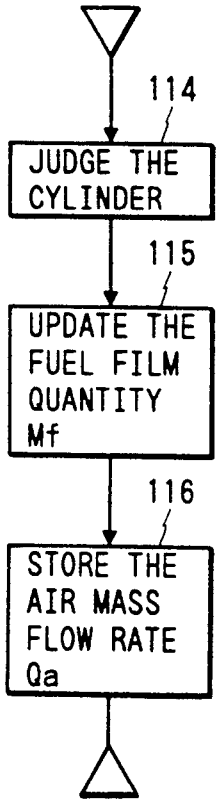
Figure 2:
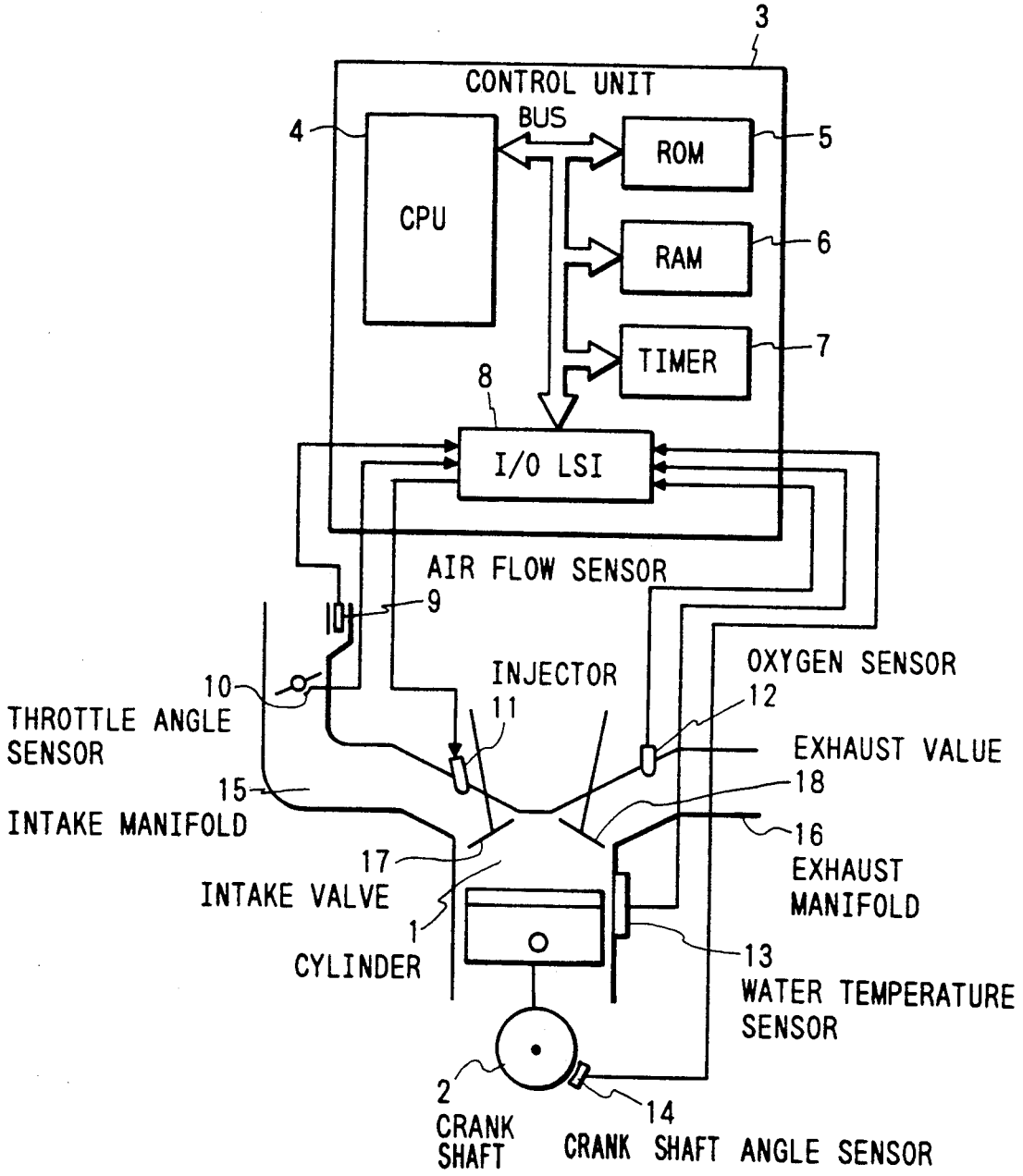
FIG. 2 is a block diagram of an engine fuel injection control apparatus for carrying out an engine fuel injection control method which embodies the present invention.

Referring now to FIGS. 1*a*–1*b* and 2 of the drawing, there are shown flowcharts of an engine fuel injection control method which embodies the present invention and a block diagram of a fuel injection control apparatus for carrying out the method of FIG. 1a–1b in a multi-point fuel injection system, respectively.

Before description of these embodiments, why asynchronous injection is necessary will be explained to aid in understanding the embodiment.

Figure 3:
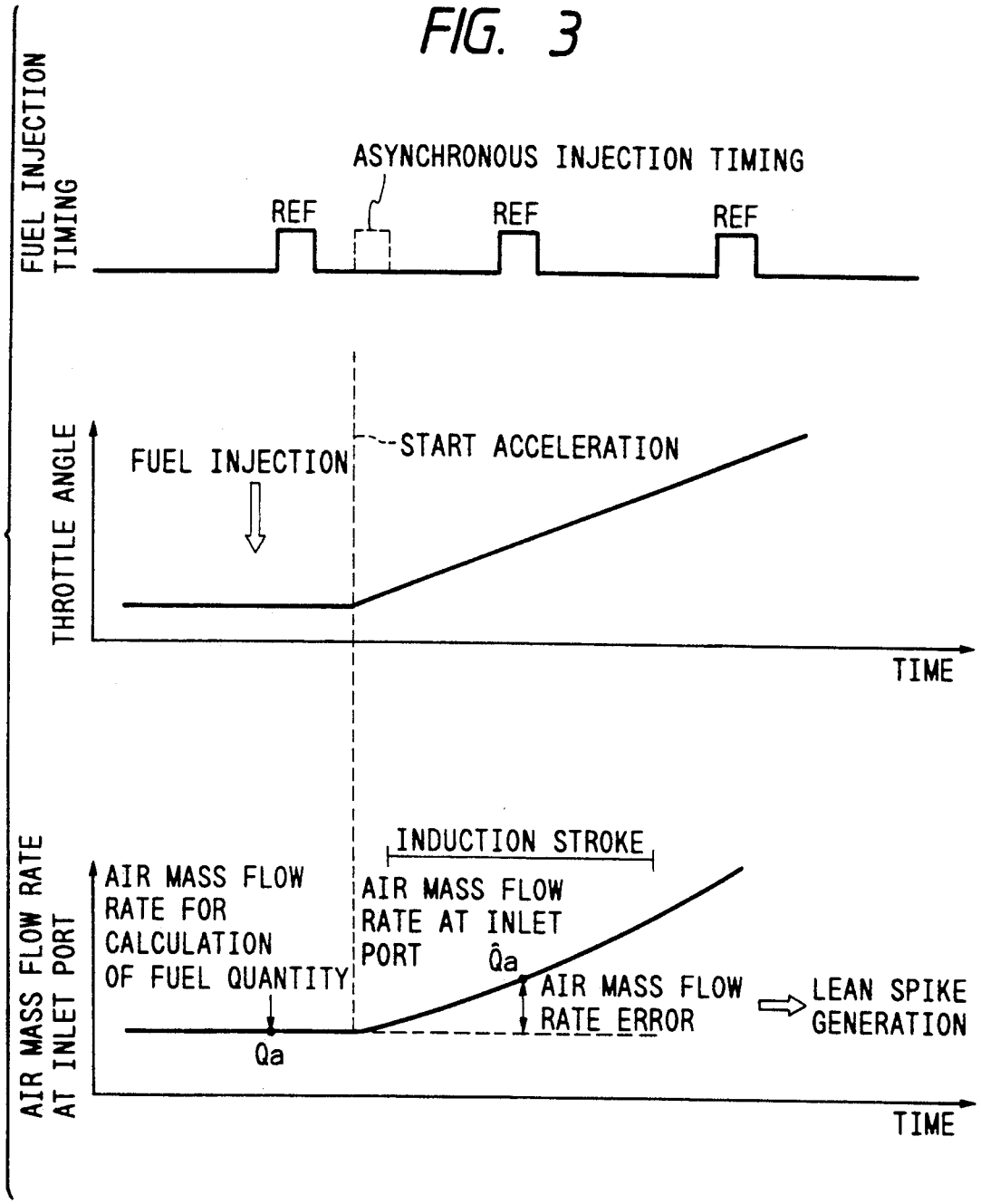
FIG. 3 is an explanatory representation concerning the necessity of asynchronous injection in an engine.

FIG. 3 shows characteristics illustrating the timing of fuel injections, the angle of the throttle and the responding air mass flow rate at the inlet port during the acceleration of a vehicle. They show how fuel is injected by the input of the timing signal REF for timing a synchronous injection and the start of acceleration immediately after that. Ordinary engines have a fuel injection (synchronous injection) one stroke before their induction stroke. Thus, their fuel injection time is shown to be to the left of the induction stroke in FIG. 3.

Qa represents the air mass flow rate used for calculation of synchronous fuel injection quantity. When acceleration starts immediately after a synchronous injection, the air mass flow rate $\hat{Q}a$ at the inlet port in the induction stroke when fuel will be flowing into the cylinder (the mass flow rate of the air actually drawn into the cylinder) is much greater than the air mass flow rate Qa used for calculating the quantity of the synchronous injection quantity. Thus, when fuel is supplied only with synchronous injection at the time of acceleration, such an engine lacks the quantity of fuel corresponding to the air mass flow rate error ($\Delta Qa = \hat{Q}a - Qa$), and the air fuel ratio has a temporary rise, generating a lean spike. As acceleration is more rapid, the air mass flow rate error $\Delta Qa$ becomes larger along with the lean spike.

To compensate for a great shortage of fuel due to rapid acceleration, it is necessary to perform an asynchronous injection before an induction stroke.

As shown in FIG. 3, the air mass flow rate error depends on the time of acceleration in relation to that of an induction stroke and the responding air mass flow rate at the inlet port, namely the responding change of the air mass flow rate at the inlet port for a unit of time. Therefore, an asynchronous fuel injection quantity must be determined in compliance with the time of acceleration in relation to an induction stroke and with the air mass flow rate at the inlet port. Otherwise, proper control of fuel injection is impossible.

Now, the embodiments of the present invention which are shown in FIGS. 1a–1b and 2 will be described. In the apparatus for control of engine fuel injection which is shown in FIG. 2, a control unit 3 is composed of a CPU 4, ROM 5, RAM 6, timer 7, an I/O LSI 8 and a bus for connecting them electrically. The information resulting from the detection by a throttle angle sensor 10, an air flow sensor 9, a water temperature sensor 13, a crank shaft angle sensor 14 and an oxygen sensor 12 is sent to the RAM 6 through the I/O LSI 8 installed in the control unit 3. The I/O LSI 8 issues an injection valve drive signal to an injector 11. The timer 7 sends an interruption request to the CPU 4 at a certain interval. The CPU 4 executes a control program, which is stored in the ROM 5, for performing the processes which will be described in detail below. Note that the reference numeral 1 denotes a cylinder, 2 a crank shaft, 15 an intake manifold, 16 an exhaust manifold, 17 an intake valve, and 18 an exhaust valve.

Now, in reference to the flowcharts in FIGS. 1a–1b, the calculation of synchronous and asynchronous injection quantities by the above-mentioned control unit 3 and the process of synchronous injection will be described in detail. These processes are performed in a 10 ms cycle.

First, in FIG. 1a, at step 101, the control unit obtains information from the air flow sensor 9, throttle angle sensor 10, crank shaft angle sensor 14 and water temperature sensor 13. The unit stores values which are output from the throttle angle sensor 10 until after 20 ms in order to use the values for the judgment of acceleration at the next step 102. The unit also calculates in a specific manner the air mass flow rate at the inlet port after one stroke or the present air mass flow rate at the inlet port by using information obtained by the measurement by these sensors. The unit also stores values of the air mass flow rate until after a specific length of time in order to use the values for the calculation at step 105.

At step 102, acceleration is judged. How this process is performed will now be described. The state of acceleration can be detected most swiftly by using the angle of the opening of the throttle. Therefore, it is judged that, when the change of the throttle opening angle within a specific length of time exceeds a specific value, the engine goes into the state of acceleration. For instance, it is judged that the engine goes into acceleration when the following equation is satisfied, the current time being i:

$$\theta th(i) - \theta th(i-2) > k_1 \quad (1)$$

where $\theta$th(i) is a sample of the throttle opening angle at time i (the sampling period is 10 ms), and $k_1$ is a positive constant.

When the engine is judged to be in the state of acceleration, the control unit 3 performs the processes at steps 103 to 109 for asynchronous injection and the calculation processes at steps 110 to 113 for synchronous injection. When the engine is judged to be not in the state of acceleration, only the calculation processes at steps 110 to 113 for synchronous injection are performed.

At step 103, the rate x' for the deposition of asynchronously injected fuel on the intake manifold wall is calculated by using the information obtained by the measurement at step 101. The method of calculating the rate x' will be described later in detail.

At step 104, it is judged which cylinder has the latest synchronous injection.

Step 105 is for predicting and calculating the air mass flow rate $\hat{Q}a$ of the air flowing into the cylinder judged at step 104 to have the latest synchronous injection.

Step 106 is for calculating an air mass error ($\Delta Qa = \hat{Q}a - Qa$) by using the calculated air mass flow rate Qa after one stroke, which is used for calculating the fuel quantity injected into the above-mentioned cylinder having the latest synchronous injection, and by using $\hat{Q}a$ calculated at step 105. The unit 3 stores a rate $\hat{Q}a$ for each cylinder by using a program which will be described later.

At step 107, an asynchronous fuel injection quantity $\Delta G_f$ is calculated by using the above-mentioned air mass error $\Delta Qa$ and the rate x' for the deposition of asynchronously injected fuel on the intake manifold wall, as described later.

At step 108, the above-mentioned asynchronous fuel injection quantity $\Delta G_f$ is converted into an asynchronous injection pulse width $\Delta Ti$ by using the following equation (2) in order to perform an asynchronous injection.

$$\Delta Ti = K \cdot \Delta G_f + Ts \quad (2)$$

where Ts is an idle injection period.

Step 109 is for using the following equation (3) to update the fuel film quantity $M_f$ for the cylinder judged to have the latest synchronous injection at step 104:

$$M_f \leftarrow M_f + x' \cdot \Delta G_f \quad (3)$$

This update equation expresses the increase of the fuel film quantity by $x' \cdot \Delta G_f$ due to the asynchronous injection. The update of a fuel film quantity by synchronous injection is performed by another program.

At the steps following step 109, a synchronous injection quantity is calculated.

Step 110 is, as described later, for calculating the rate x of the deposition of injected fuel on the intake manifold wall and the ratio $\alpha$ of the sucking off of a fuel film by a cylinder during an induction stroke.

At step 111, it is judged in which cylinder the next synchronous injection is to be performed.

Step 112 is for calculating a synchronous fuel injection quantity $G_f$ by using the latest fuel film quantity $M_f$ ($=M_{fold}$) calculated for the cylinder judged to have the next synchronous injection and by using the information obtained from the measurement at step 101.

At step 113, the synchronous injection pulse width Ti for the cylinder judged to have the next synchronous injection at step 111 is calculated by using the following equation (4):

$$Ti = k \cdot G_f + Ts \quad (4)$$

The processes performed by the control unit 3 are thus completed, and the unit 3 waits for the next interruption request.

FIG. 1*b* is a flowchart of the update of a fuel film quantity by the program referred to in the description of the above-mentioned step 109. This program is executed immediately after a synchronous injection is performed.

Step 114 is for judging in which cylinder the latest synchronous injection has been performed.

At step 115, the fuel film quantity for a cylinder judged to have the latest synchronous injection is updated by using the following equation (5):

$$M_f \leftarrow M_f + (x \cdot G_f - \alpha \cdot M_f) \quad (5)$$

where x, $\alpha$, $G_f$ and $M_f$ are latest values.

Step 116 is for storing the latest air mass flow rate Qa used for calculating a synchronous fuel injection quantity $G_f$ in order to use the information to calculate the air mass error $\Delta Qa$ at the above-mentioned step 106 shown in FIG. 1*a*.

Now, the above-mentioned steps will be described in detail.

To begin with, in reference to FIG. 4, a first method will be described for predicting the air mass flow rate $\hat{Q}a$ which has the latest synchronous injection after acceleration is detected at step 103. In this first method, the angle of the crank shaft is used.

Figure 4:
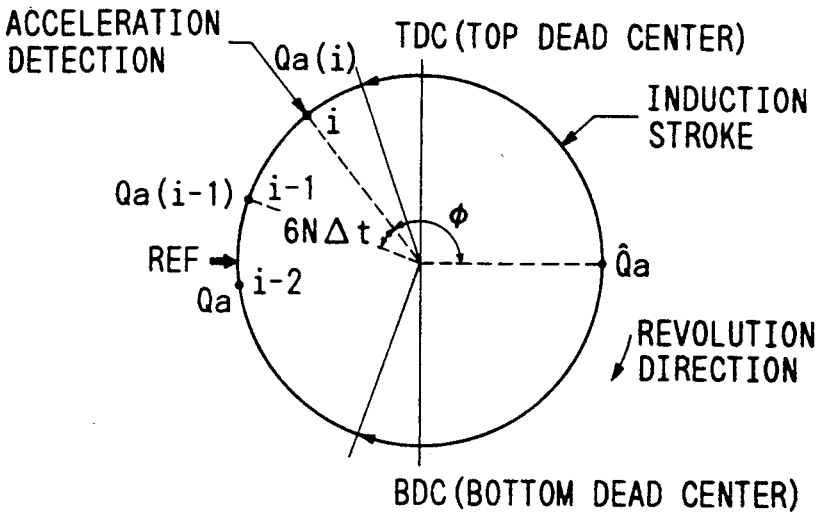
FIGS. 4 and 5 are illustrations of the timing of air mass flow rate calculation, fuel injection and an induction stroke in relation to the angle of an engine crank.

FIG. 4 is an illustration of the timing of air mass flow rate calculation, fuel injection and an induction stroke in relation to the angle of the crank shaft. The air mass flow rate $\hat{Q}a$ is represented by the air mass which flows into the cylinder when the crank shaft is positioned such that the piston for the cylinder is in the middle of an induction stroke. Let the time for calculating the air mass flow rate at the inlet port of the cylinder be i−1, i . . . and the cycle of this calculation be $\Delta t$ and the air mass flow rate at the inlet port at the time i, which has been calculated in a specific manner, be Qa(i).

If acceleration is detected at the time i, the air mass flow rate $\hat{Q}a$, which is assumed to change linearly with time, is given by the following equation (6), the number of the revolutions and the crank shaft angle between the position of the crank shaft in the time i and the position of the crank shaft in the middle of an induction stroke being N (rpm) and $\phi$ (deg) respectively:

$$\hat{Q}a = Qa(i) + \frac{\phi}{6N\Delta t}(Qa(i) - Qa(i-1)) \quad (6)$$

The use of $\phi$ for predicting $\hat{Q}a$ means that the prediction is performed indirectly by using the time of the acceleration.

A second method for predicting the air mass flow rate $\hat{Q}a$ is related to a throttle and speed method, namely, one of using the angle of the opening of the throttle and the number N of the revolutions in the manner described below.

Since engines in ordinary vehicles inject fuel one stroke (a crank shaft angle of about 180 degrees) before the induction stroke, the air mass flow rate after one stroke is needed for determining a proper fuel injection quantity at the time of its calculation. In this throttle and speed method, a throttle opening angle is applied to the prediction of the angle after one stroke, and thus using the predicted value for the same calculation of the air mass as specified earlier obtains the air mass flow rate after one stroke.

For throttle opening angle prediction, an equation (7) may be used:

$$\hat{\theta}th(i) = \theta th(i) + \frac{T}{\Delta t}(\theta th(i) - \theta th(i-1)) \quad (7)$$

where $\theta$th(i) is a detected throttle opening angle, $\hat{\theta}$th(i) is a predicted throttle opening angle, $\Delta t$ is a throttle opening angle detection cycle and T is the time for one stroke (time required for a half revolution of the engine).

When the angle of the throttle changes smoothly in a transient condition, the equation (7) works accurately, and so it is possible to predict the air mass flow rate after one stroke. However, when the angle of the throttle changes abruptly from a certain constant condition during rapid acceleration, the equation (7) does not work accurately as far as the early stage of acceleration is concerned, and so it is impossible to predict the air mass flow rate after one stroke. The reason is that with the angle of the throttle in a certain constant condition it is impossible to predict such an abrupt change of the angle. Therefore, an asynchronous fuel injection is necessary also for this throttle and speed method.

Now, how the air mass flow rate $\hat{Q}a$ is predicted in this throttle and speed method will be described.

Figure 5:
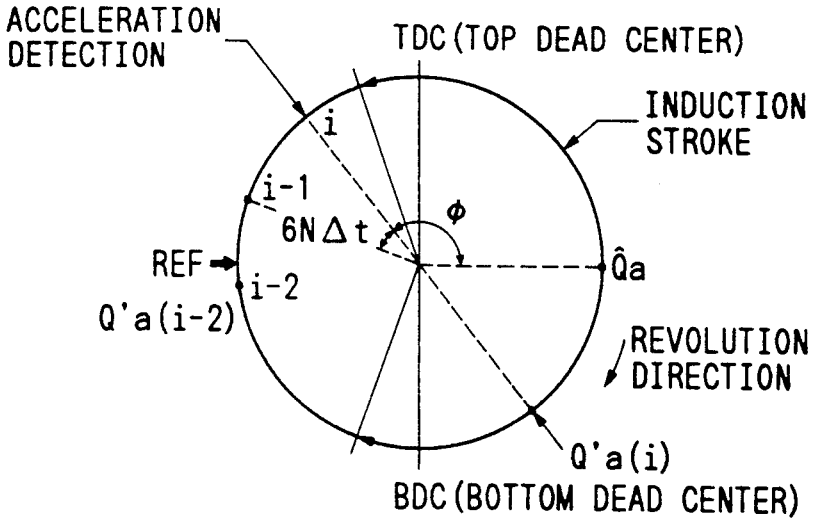

FIG. 5 is an illustration of the timing of air mass flow calculation rate, fuel injection and an induction stroke in relation to the angle of the crank shaft. i−2, i−1 and i each are the time for calculating the air mass flow rate at the inlet port, $\Delta t$ is the cycle of the calculation of the air mass, N is the number of revolutions, $\phi$ is the crank shaft angle between the time i and the position of the crank shaft when the piston is in the middle of an induction stroke and Qa'(j) (j=i−2, i−1, i) is the calculated air mass flow rate at the inlet port one stroke after time j.

If acceleration is detected at the time i after fuel is injected, Qa'(i) can be considered to be a value after one stroke since the angle of the throttle has already changed. This value represents the air mass flow rate at the inlet port with the crank shaft in the position for it in FIG. 5. On the other hand, no acceleration occurs at the time i−2, so Qa'(i−2) represents the value of the air mass flow rate at the inlet port at the time i−2, namely, when the crank shaft is in the position for it in the illustration. Therefore, the air mass flow rate $\hat{Q}a$ with the crank shaft positioned in the middle of an induction stroke is, assuming that the air mass flow rate changes linearly with respect to time, given by the following proportional distribution equation (8) using Qa'(i) and Qa'(i−2):

$$\hat{Q}a = \frac{(180 - \phi)Qa'(i-2) + 180Qa'(i)}{360 - \phi} \quad (8)$$

where it is assumed that in the middle of an induction stroke the crank shaft is positioned a crank angle of 90 degrees after top dead center (TDC), that fuel injection time REF is a crank shaft angle of 90 degrees before TDC and that fuel injection time REF and the time for calculating Qa (i−2) used for calculating the fuel injection quantity almost coincide with each other.

There may be a third method for predicting the air mass flow rate $\hat{Q}a$. This method is a throttle and speed method and is used, in the system for calculating the air mass flow rate Qa(i) in a specific cycle, to predict the air mass flow rate Qa'(i) after one stroke by using the following equation (9) and then to calculate $\hat{Q}a$ by using the equation (8):

$$Qa'(i) = Qa(i) + \frac{T}{\Delta t}\{Qa(i) - Qa(i-1)\} \quad (9)$$

where Δt is the cycle of the calculation of the air mass flow rate, and T is the time for one stroke.

According to the above methods, it is possible to calculate $\hat{Q}a$ almost at the same time that acceleration is detected and thus to supply fuel properly.

Now, the method of calculating a fuel shortage $G_{f0}$ corresponding to the air mass flow rate error $\Delta\hat{Q}a$ handled at step 107 shown in FIG. 1 will be described.

The fuel shortage $G_{f0}$ is given by the following equation (10), the objective air fuel ratio being $(A/F)_0$:

$$G_{f0} = \frac{\Delta Qa}{(A/F)_0} \quad (10)$$

If all injected fuel is introduced into the cylinder, the fuel quantity given by the equation (10) could be injected asynchronously. In reality, however, part of injected fuel is deposited on the inlet port, causing fuel transport delay. It is necessary, therefore, to take this delay into account in order to determine a proper fuel injection quantity.

A method of compensating for such a fuel transport delay will now be described.

In this method, the following equations are used as models for compensating for fuel transport delay:

$$G_{fe} = (1-x)\cdot G_f + \alpha\cdot M_f\text{old} \quad (11)$$

$$M_{fnew} = M_f\text{old} + (X\cdot G_f - \alpha\cdot M_f\text{old}) \quad (12)$$

where $G_{fe}$ is the quantity (g) of the fuel coming into the cylinder, $G_f$ is a synchronous fuel injection quantity (g), $M_{fold}$ is the fuel film quantity (g) before fuel injection, $M_{fnew}$ is the fuel film quantity (g) at the end of an induction stroke after fuel injection, x is the rate of the deposition of injected fuel on the intake manifold wall and α is the ratio of the sucking off of a fuel film by the cylinder during an induction stroke.

Figure 6:
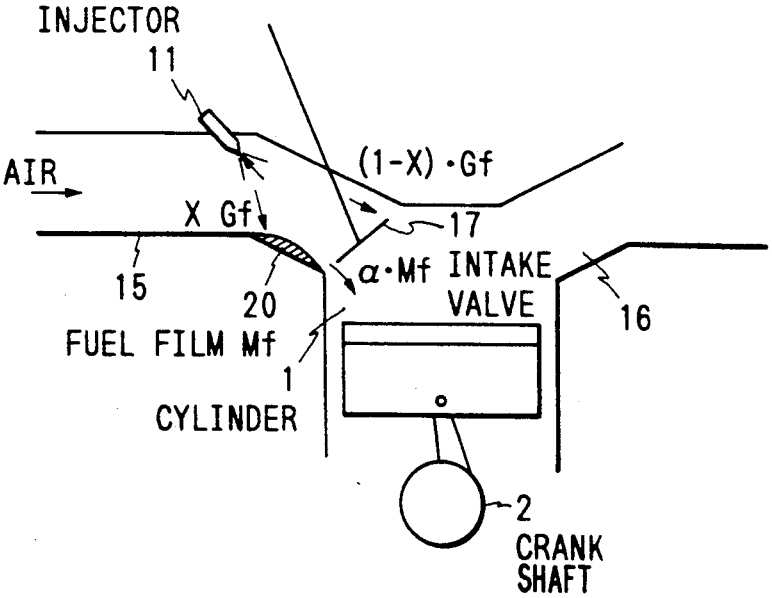
FIG. 6 is a view of the course of fuel in an intake manifold.

FIG. 6 is a view of a cylinder and the intake manifold of an engine for explaining how the equations (11) and (12) work. The equation (11) expresses the flow into the cylinder 1 of the fuel (1−x) $G_f$ not deposited on the intake manifold wall which is part of the fuel $G_f$ injected by an injector 11 and the fuel $\alpha\cdot M_{fold}$ whose part is sucked off by the cylinder. The equations (12) expresses the increase of the fuel film quantity from $M_{fold}$ by $x\cdot G_f$ due to fuel injection and its decrease to $M_{fnew}$ by $\alpha\cdot M_{fold}$ during an induction stroke.

When an asynchronous injection is performed, the equations (11) and (12) are written as follows:

$$G_{fe} = (1-x')\,G_f + (1-x')\,\Delta G_f + \alpha\cdot M_{fold} \quad (13)$$

$$M_{fnew} = M_{fold} + (x\cdot G_f + \cdot\Delta G_f - \alpha M_{fold}) \quad (14)$$

where $\Delta G_f$ is an asynchronous fuel injection quantity (g), and x' is the rate of the deposition of asynchronously injected fuel on the intake manifold wall. Let the air mass flow rate which has been calculated in a specific manner by Qa (g/s), and then the air mass $\overline{Q}a$ (g) flowing into the cylinder is given by:

$$\overline{Q}a = k\cdot\frac{Qa}{N} \quad (15)$$

where k is a constant and N is the number of revolutions.

With regard to the air mass $\overline{Q}a$ flowing into the cylinder, a desired air fuel ratio $(A/F)_0$ can be achieved by satisfying the following equation:

$$\frac{\overline{Q}a}{\overline{G}_{fe}} = (A/F)_0 \quad (16)$$

By combining the equations (11) and (16), the following equation is derived for the synchronous fuel injection quantity $G_f$:

$$G_f = \frac{\dfrac{\overline{Q}a}{(A/F)_0} - \alpha\cdot M_{fOld}}{1-x} \quad (17)$$

In this equation, when $\overline{Q}a$ is a correct air mass flowing into the cylinder, the synchronous fuel injection quantity $G_f$ is a proper fuel injection quantity.

However, as stated earlier, just before acceleration it is impossible to correctly obtain the air mass flowing into the cylinder, and the resulting shortage of fuel due to $G_f$ is the reason why an asynchronous injection is necessary.

After acceleration is detected according to the above-mentioned method, the predicted air mass flow rate at the inlet port being $\hat{Q}a$, its air mass $\overline{Q}a$ is given by the following equation (18):

$$\overline{Q}a = k\cdot\frac{\hat{Q}a}{N} \quad (18)$$

A desired air fuel ratio can be achieved by satisfying the following equation (19):

$$\frac{\widetilde{Qa}}{G_{fe}} = (A/F)_0 \quad (19)$$

From the equations (13) and (19), the following equation (20) for the asynchronous injection quantity $\Delta G_f$ is obtained:

$$\Delta G_f = \frac{\frac{\widetilde{Qa}}{(A/F)_0} - (1-x)\,G_f - \alpha \cdot M_{fOld}}{1-x'} \quad (20)$$

where $G_f$ is a synchronous fuel injection quantity calculated by using the equation (17).

Here, substituting the equation (17) into the equation (20) simplifies the latter into:

$$\Delta G_f = \frac{\frac{\widetilde{Qa} - \overline{Qa}}{(A/F)_0}}{1-x'} = \frac{\frac{1}{(A/F)_0} \cdot k \cdot \frac{\Delta Qa}{N}}{1-x'} \quad (21)$$

Note that determining a fuel injection quantity by using the equations (17) and (20) requires use of the values of x, x', $\alpha$ and $M_{fold}$.

x, x' and $\alpha$ are formulated in advance by a particular experiment. They are, after all, given by such equations as:

$$x = f_1\,(Qa,\ N) \quad (22)$$

$$x' = f_2\,(Qa,\ N,\ \phi) \quad (23)$$

$$\alpha = g\,(Qa,\ N,\ T_W) \quad (24)$$

where $F_1$, $f_2$ and g are specific operators, Qa is an air mass flow rate, N is the number of revolutions, Tw is the temperature of water and $\phi$ is the crank shaft angle during asynchronous injection.

The reason why x' has a crank angle is that asynchronous injection is not so constant in respect of injection timing as synchronous injection with the result that there is a difference between them in fuel deposition condition. The injection quantity $M_f$ is updated by using the equation (14) so that a latest value can be used for determining a synchronous injection quantity.

In a multi-point fuel injection system, since each cylinder has fuel films, fuel is controlled by determining a fuel film quantity for each cylinder.

FIG. 7 illustrates the calculation processes for the fuel control by synchronous and asynchronous injection for a cylinder of such a multi-point fuel injection system. The parenthesized numbers attached to the blocks in the illustration are those of the equations so far used for description.

Block 51 is for calculating the deposition rate x and the sucking-off ratio $\alpha$ by using the calculated air mass flow rate Qa'(i) at the inlet port after one stroke, the number N of engine revolutions, and the water temperature Tw.

In block 52, the fuel film quantity $M_f$ is updated by using the fuel deposition rates x and x' and the sucking-off ratio $\alpha$, the synchronous injection quantity $G_f$ and the asynchronous injection quantity $\Delta G$. The fuel film quantity $M_f$ is updated every time fuel injection is completed. This update is performed every cycle.

In block 53, the quantity of an injection is calculated by using the fuel deposition rate x, the sucking-off ratio $\alpha$, the latest fuel film quantity $M_f$, the number N of revolutions and the air mass flow rate Qa'(i) at the inlet port after one stroke.

Block 54 is for calculating the synchronous injection pulse width Ti by using the injection quantity $G_f$. In the equation, k is a constant, and Ts is an idle injection period.

The calculation in blocks 51 and 53 is performed at a specific interval only when the cylinder subject to the fuel control system is a cylinder where the next injection is carried out. In response to an REF signal, fuel is injected with the latest synchronous injection pulse width Ti.

Blocks 55 to 58 work when the engine changes from the steady driving status into the acceleration status when, though the cylinder subject to the system has undergone a synchronous injection, no synchronous injection has yet been applied to any other cylinders.

In block 55, the air mass flow rate $\hat{Q}a$ during an induction stroke of the subject cylinder is calculated by using Qa'(i), $\phi$ and the number N of revolutions (by the throttle and speed method for detecting the air mass flow rate which has been described as the third method for step 105 shown in FIG. 1).

In block 56, the fuel deposition rate x' is calculated by using the calculated air mass flow rate Qa'(i) at the inlet port after one stroke, the number N o 20 of engine revolutions, the crank shaft angle $\phi$ between the time and the position of the crank shaft in the middle of an induction stroke. In block 57, the asynchronous injection quantity $\Delta Gf$ is calculated by using the air mass error $\Delta Qa$, the number N of revolutions, and the fuel deposition rate x', and further, in block 58, the asynchronous injection pulse width $\Delta Ti$ is calculated. Immediately after the calculation of $\Delta Ti$, asynchronous injection is performed.

Effects of the Invention

According to the present invention, an asynchronous fuel injection quantity can be determined without using a table whose matching would be required for each engine model, so the processes of developing an engine fuel injector can be decreased in number.

Besides, according to the present invention, the shortage of fuel occurring with the synchronous injection at the early stage of acceleration is determined logically in compliance with the time of acceleration so as to provide a proper quantity of asynchronously injected fuel in various drive modes to make up for the shortage. This allows air fuel ratio control to be more accurate.

What is claimed is:

1. An engine control method of controlling the quantity of a fuel supply to a cylinder according to the air mass flow rate, comprising the steps of:

detecting the state of acceleration of the engine and also judging whether or not the engine is in a specific acceleration state;

when said engine is judged at said judgment step to be in a specific state of acceleration, predicting the air mass flow rate of the air flowing into a specific cylinder having undergone a fuel injection;

determining a proper asynchronous fuel injection quantity, for said acceleration state, to be injected into said specific cylinder on the basis of the difference between the predicted air mass flow rate and an air mass flow rate used for determining the quantity of the latest injection into said specific cylinder; and then asynchronously injecting the determined quantity of fuel into said specific cylinder.

2. An engine control method according to claim 1 wherein, in said step of determining an asynchronous injection quantity, a supplemental fuel supply quantity is determined which is necessary for achieving a proper air fuel ratio for said specific acceleration state.

3. An engine control method according to claim 1 wherein, said specific cylinder is a cylinder that has undergone the latest fuel injection.

4. An engine control method according to claim 1 wherein, in said judgment step, such judgment depends on whether or not a variation of the angle of the throttle of said engine for a unit of time exceeds a specific value.

5. An engine control method according to claim 1 wherein, in said step of predicting the air mass flow rate, such prediction depends on the value resulting from the calculation in a specific cycle of the air mass flow rate of the air flowing into the cylinder.

6. An engine control method according to claim 1 wherein, in said step of predicting the air mass flow rate, such prediction depends on a predicted value of said air mass flow rate of the air which flows into a specific cylinder after a specific length of time.

7. An engine control method according to claim 1 wherein, in said step of determining an asynchronous fuel injection quantity, the fuel supply quantity is determined so that the ratio of said difference to the sum of the quantity of injected fuel flowing directly into said specific cylinder and that of fuel deposited on the intake manifold wall and then sucked off into the cylinder is a desired air fuel ratio.

8. An engine control method according to claim 1 wherein, in said step of determining an asynchronous fuel injection quantity, the fuel supply quantity is determined on the basis of said difference and a calculated value of the fuel deposition rate which indicates rate of deposition of the injected fuel to the intake manifold wall.

9. An engine control method according to claim 8 wherein said fuel deposition rate is calculated on the basis of a detected value of the crank shaft angle.

10. An engine control method of controlling the quantity of a fuel supply to a cylinder according to the air mass flow rate, comprising the steps of:

detecting the state of acceleration of the engine and also judging whether or not the engine is in a specific acceleration state;

detecting the value of the crank shaft angle of said engine;

when said engine is judged at said judgment step to be in a specific state of acceleration, using the detected value of the crank shaft angle to predict the air mass flow rate of the air flowing into a specific cylinder having undergone a fuel injection;

using the predicted air mass flow rate to determine a proper asynchronous fuel injection quantity for said acceleration state for said specific cylinder; and then asynchronously injecting the determined quantity of fuel into said specific cylinder.

11. An engine control method according to claim 10 wherein, in said step of determining an asynchronous fuel injection quantity, the fuel supply quantity is determined on the basis of the difference between the predicted air mass flow rate and an air mass flow rate used for determining the quantity of the latest injection into said specific cylinder.

12. An engine control method according to claim 10 wherein, in said step of predicting the air mass flow rate, said air mass flow rate is predicted on the basis of the crank shaft angle difference between the current crank shaft angle position and a specific crank shaft angle position in the induction stroke.

13. An engine control method according to claim 10 wherein, in said step of determining an asynchronous fuel injection quantity, the fuel supply quantity is determined on the basis of said difference and a calculated value of the fuel deposition rate which indicates rate of deposition of the injected fuel to the intake manifold wall.

14. An engine control method according to claim 13 wherein said fuel deposition rate is calculated on the basis of a detected value of the crank shaft angle.

15. An engine control apparatus for controlling the quantity of a fuel supply to a cylinder according to the air mass flow rate, comprising:

means for detecting the state of acceleration of the engine and also judging whether or not the engine is in a specific acceleration state;

means for, when said engine is judged at said judgment step to be in a specific state of acceleration, predicting the air mass flow rate of the air flowing into a specific cylinder having undergone a fuel injection;

means for determining a proper asynchronous fuel injection quantity, for said acceleration state, to be injected into said specific cylinder on the basis of the difference between the predicted air mass flow rate and an air mass flow rate used for determining the quantity of the latest injection into said specific cylinder; and means for asynchronously injecting the determined quantity of fuel into said specific cylinder.

16. An engine control apparatus for controlling the quantity of a fuel supply to a cylinder according to the air mass flow rate, comprising:

means for detecting the state of acceleration of the engine and also judging whether or not the engine is in a specific acceleration state;

means for detecting the value of the crank shaft angle of said engine;

means for, when said engine is judged by said judgment means to be in a specific state of acceleration, using the detected value of the crank shaft angle to predict the air mass flow rate of the air flowing into a specific cylinder having undergone a fuel injection;

means for using the predicted air mass flow rate to determine a proper asynchronous fuel injection quantity for said acceleration state for said specific cylinder; and means for asynchronously injecting the determined quantity of fuel into said specific cylinder.

17. An engine control apparatus according to claim 16 wherein, in said means for predicting the air mass flow rate, said air mass flow rate is predicted on the basis of the crank shaft angle difference between the current crank shaft angle position and a specific crank shaft angle position in the induction stroke.

* * * * *